US007535351B2

(12) United States Patent
Reymond

(10) Patent No.: US 7,535,351 B2
(45) Date of Patent: May 19, 2009

(54) ACOUSTIC INTRUSION DETECTION SYSTEM

(76) Inventor: Welles Reymond, 380 Hitchcock Rd. #84, Waterbury, CT (US) 06705

( * ) Notice: Subject to any disclaimer, the term of this patent is extended or adjusted under 35 U.S.C. 154(b) by 201 days.

(21) Appl. No.: 11/459,579

(22) Filed: Jul. 24, 2006

(65) Prior Publication Data

US 2008/0018461 A1 Jan. 24, 2008

(51) Int. Cl.
*G08B 13/00* (2006.01)

(52) U.S. Cl. ..... 340/541; 340/544; 367/93; 367/187

(58) Field of Classification Search ..... 340/541, 340/544; 367/93, 187
See application file for complete search history.

(56) References Cited

U.S. PATENT DOCUMENTS

| | | | | |
|---|---|---|---|---|
| 3,754,222 | A | 8/1973 | Eisenberg | |
| 3,828,336 | A | 8/1974 | Massa | |
| 3,974,489 | A | 8/1976 | Bleeker et al. | |
| 4,097,853 | A | 6/1978 | Francis, Jr. | |
| 4,196,423 | A | 4/1980 | Carver et al. | |
| 4,229,811 | A | 10/1980 | Salem | |
| 4,386,343 | A | 5/1983 | Shiveley | |
| 4,479,113 | A | 10/1984 | McNeilly et al. | |
| 4,609,909 | A | 9/1986 | Miller et al. | |
| 4,661,936 | A | 4/1987 | Magee et al. | |
| 4,719,452 | A | 1/1988 | Logsdon | |
| 4,729,120 | A | 3/1988 | Steiner et al. | |
| 4,746,910 | A | 5/1988 | Pfister et al. | |
| 4,991,146 | A | 2/1991 | Ransdell et al. | |
| 5,021,766 | A | 6/1991 | Genahr et al. | |
| 5,323,141 | A | 6/1994 | Petek | |
| 5,355,350 | A | 10/1994 | Bass et al. | |
| 5,396,217 | A | 3/1995 | Proefke et al. | |
| 5,519,669 | A * | 5/1996 | Ross et al. | 367/93 |
| 5,608,377 | A | 3/1997 | Zhevlev et al. | |
| 5,696,489 | A | 12/1997 | Haynes et al. | |
| 5,828,626 | A | 10/1998 | Castile et al. | |
| 5,856,778 | A | 1/1999 | Kani et al. | |

(Continued)

FOREIGN PATENT DOCUMENTS

| | | |
|---|---|---|
| DE | 19533192 | 3/1997 |

(Continued)

OTHER PUBLICATIONS

Paul Rosemberg, "Facility Security: Instrusion Systems, Part 1" Jul. 1, 2000, downloaded from internet www.ecmweb.com/mag/electric_facility_security_intrusion_2/.

*Primary Examiner*—Jeff Hofsass
*Assistant Examiner*—Ojiako Nwugo
(74) *Attorney, Agent, or Firm*—Gordon & Jacobson, PC

(57) ABSTRACT

An active acoustic intrusion detection system includes a pair of dipole emitters (180 degrees out of phase with each other) which emit an audible frequency f (preferably 1 KHz) and a pair of detectors preferably mounted ¼ wavelength (3 inches) apart in the (non-echoic) nulls of the emitters. The detectors (microphones) spatially sample a stationary wave which is generated by the emitters (speakers). The output of each microphone is fed to an ADC and the digital output of the two ADCs is used to generate a four dimensional vector. At start-up, a reference vector is determined and stored. During operation, vectors are sampled, filtered, smoothed and averaged periodically. When an average vector deviates from the reference vector by a set amount, an alarm is generated.

19 Claims, 5 Drawing Sheets

U.S. PATENT DOCUMENTS

| | | | | |
|---|---|---|---|---|
| 5,973,996 | A | 10/1999 | Zhevelev et al. | |
| 6,337,625 | B1 | 1/2002 | Taylor et al. | |
| 6,592,375 | B2 * | 7/2003 | Henry et al. | 434/62 |
| 6,631,096 | B2 | 10/2003 | Gillis et al. | |
| 6,703,932 | B2 | 3/2004 | Matsuzawa | |
| 2001/0033227 | A1 | 10/2001 | Eskildsen et al. | |
| 2007/0041590 | A1 * | 2/2007 | Tice | 381/77 |

FOREIGN PATENT DOCUMENTS

| | | | |
|---|---|---|---|
| EP | 0188165 | | 7/1986 |
| EP | 0572302 | | 12/1993 |
| EP | 0654768 | | 5/1995 |
| EP | 0541881 | | 7/1995 |
| EP | 1039313 | | 3/2000 |
| GB | 2083672 | | 3/1982 |
| JP | 06168382 | A2 | 5/1993 |
| JP | 200298776 | A2 | 10/2000 |
| JP | 2004122946 | A | 4/2004 |
| RU | 2006950 | | 1/1994 |
| RU | 2019869 | | 9/1994 |
| RU | 2031445 | | 3/1995 |
| RU | 2053561 | | 1/1996 |
| RU | 2094852 | | 10/1997 |
| RU | 2103742 | | 1/1998 |
| RU | 2150750 | | 6/2000 |
| SU | 1196693 | A1 | 7/1989 |
| WO | WO96/27862 | | 9/1996 |

* cited by examiner

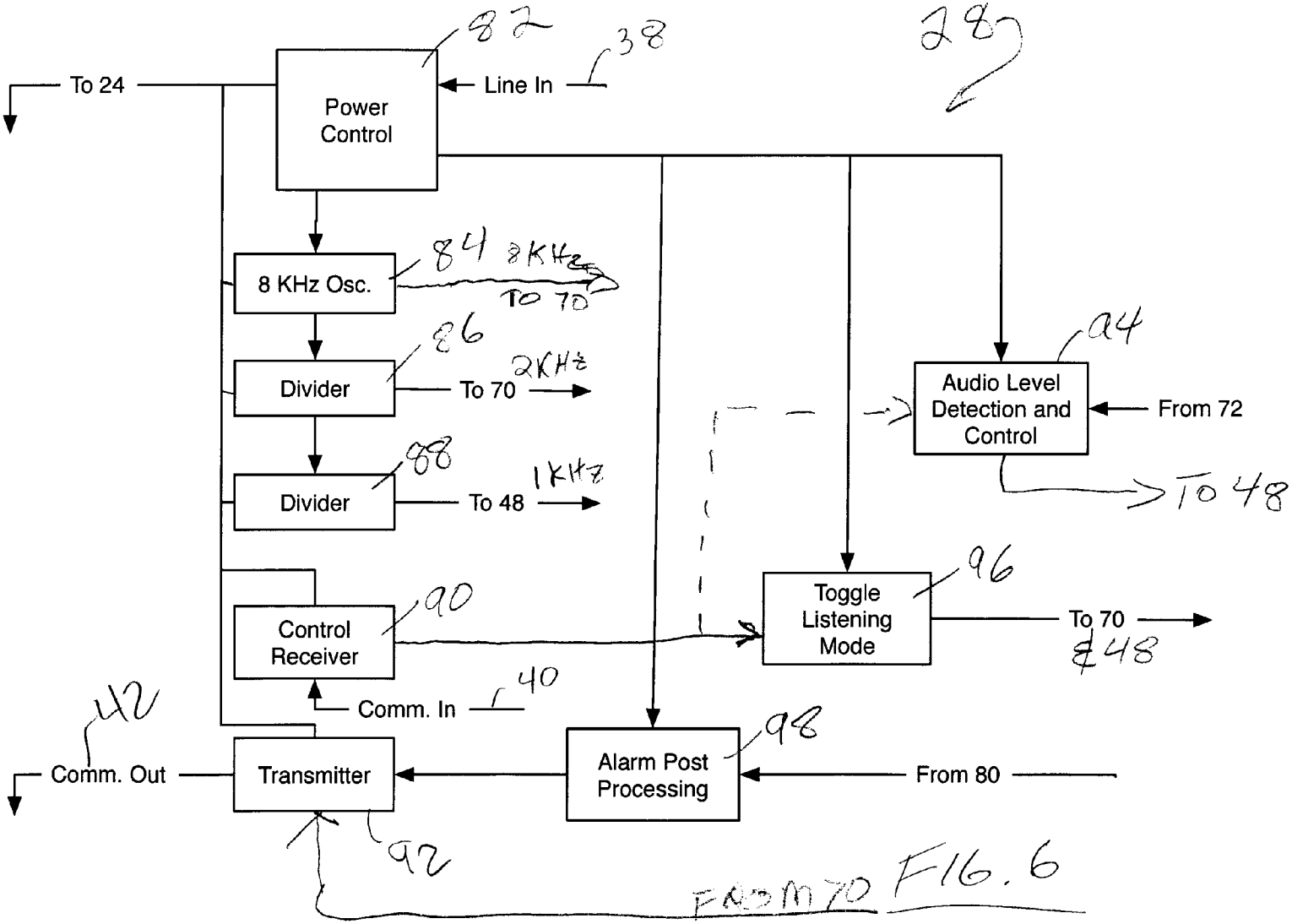
FROM 72 FIG. 6

ACOUSTIC INTRUSION DETECTION SYSTEM

BACKGROUND OF THE INVENTION

1. Field of the Invention

This invention relates broadly to electronic security systems. More particularly, this invention relates to an acoustic intrusion detection system utilizing audible stationary sound waves.

2. State of the Art

Electric or electronic security systems have been in use for nearly 100 years. These systems employ many different kinds of sensors to detect an unlawful intrusion into a protected space. One such sensor is a motion detector. The most popular motion detectors are infrared (IR) and ultrasonic. Despite the many advances in the sophistication of security systems, some intrusions go undetected. At other times a sensor produces a false positive detection.

While the problem of an undetected intrusion is self-evident, false positives also pose a significant problem. Typically, when an intrusion is detected, a signal is sent to a central monitoring station which monitors the security systems of many customers. The monitoring station then informs the local police to investigate the intrusion. Most police departments have a policy that if they are called more than a certain number of times for a false positive intrusion detection, they will not respond to any more calls regarding that site.

False positive detection by ultrasonic motion detectors can be triggered by many different events including wind, loud noises near the protected space, and the movement of rodents or other small animals. In order to minimize false detection, some security companies install listening equipment in the protected space. When a motion detector triggers an alarm, someone at the monitoring station listens to hear if there is real intrusion or a false alarm. This works sometimes, but not always, and requires human resources.

State of the art motion detectors need a "line of sight" to the moving object to detect the motion. Because of this limitation, it may be necessary to install several motion detectors in the protected space.

Many known motion detectors are also adversely affected by change in temperature. Many also require a relatively fast digital signal processor. IR motion detectors are easily disabled with hair spray. Ultrasonic detectors can be disabled by covering them with a sound absorbing cover. It should be noted that many intrusions are by employees who attempt to disable the security system during the day so they can return at night undetected.

SUMMARY OF THE INVENTION

It is therefore an object of the invention to provide an intrusion detector which minimizes false alarms.

It is another object of the invention to provide an intrusion detector which maximizes true intrusion detection.

It is also an object of the invention to provide an intrusion detector which can also be used as a listening device.

It is an additional object of the invention to provide an intrusion detector which is non-sensitive to ambient noise.

It is still another object of the invention to provide an intrusion detector that is easy to install and operate.

It is another object of the invention to provide an intrusion detector which does not need a "line of sight" to detect intrusion.

It is a further object of the invention to provide an intrusion detector which can detect static changes in the protected space.

It is also an object of the invention to provide an intrusion detector which can self-correct for changes in temperature.

It is an additional object of the invention to provide an intrusion detector which is not easily spoofed.

It is still another object of the invention to provide an intrusion detector which does not require extensive digital signal processing.

It is a further object of the invention to provide an intrusion detector system which can function as an annunciator.

In accord with these objects, which will be discussed in detail below, the preferred acoustic intrusion detection system includes a pair of emitters (configured as a dipole) 180 degrees out of phase with each other which emit an audible frequency f (preferably 1 KHz) and a pair of detectors preferably mounted ¼ wavelength (3 inches) apart in the (non-echoic) nulls of the emitters. Non-echoic nulls are determined in an environment having no or far away sound reflectors so that the only way for the microphones can hear the emitters is directly from the emitters. The microphones are located so that no sound from the emitters is detected. The detectors (microphones) sample a stationary wave which is generated by the emitters (speakers). The output of each microphone is fed to an analog to digital converted (ADC) and the digital output is used to generate a two dimensional vector (amplitude and phase). The amplitude and phase are treated as rectangular coordinates even though they are in fact polar coordinates. At startup, a reference vector is determined and stored. During operation, vectors are sampled and averaged periodically. When an average vector deviates from the reference vector by a set or settable amount, an alarm is generated. A plurality of intrusion detector systems can be installed at the same site provided that they do not interfere with each other. One way to avoid interference is to require that the systems all operate from a central clock so that they all emit the same frequency. When more than one system is used, the systems may be turned on in sequence. It may be necessary for some systems to recalculate their reference vector if they "hear" sound from other systems. Therefore, the sequencing procedure preferably includes signaling the other systems to recalculate their reference vectors.

In the case where the security service wants to have a human verification of an intrusion alarm, the sensors of the invention can also provide a listening capability, in digital form, (e.g. PCM), without significant additional cost. In addition, since the sound is audible, the sensors indicate that they are operating and can be used as annunciators.

According to the preferred embodiment, the output of each microphone is fed to its own ADC and the output of each ADC is fed to a sample selector and sign changers. Samples are taken at 90° (of the operating frequency) intervals. Odd samples are sent to one accumulator and even samples are sent to another accumulator. However, the sign of every other odd sample is changed and the sign of every other even sample is changed. By changing the signs in this way, the magnitude of the f component values in the accumulators always increase. Although one of them may be a negative number, its absolute value always increases. Conversely, the magnitude of "random" (noise) components will not always increase and will, over time, cancel each other out. Samples are taken for a period of time during which there is no motion and low noise in the protected space. The content of the accumulator is the sum of the samples taken. The samples are averaged by truncating the content of the accumulator. These four averaged samples are treated as the ordinates of a four dimensional vector which is the reference vector. The magnitude of this vector is calculated according to the Pythagorean Theorem for four dimensions. Once the reference vector is determined, samples continue to be taken and averaged periodically thereby providing periodic four dimensional vectors. The ordinates of the periodic vectors are subtracted from the ordinates of the reference vector, producing a difference vector. The magnitude of the difference vector is compared to the magnitude of the reference vector. If the magnitudes differ by a predetermined or set amount (e.g. 10%) an alarm condition is indicated. Optionally, post processing may be applied such that an alarm is not reported unless several difference vectors within a period of time differ from the reference vector by the predetermined or set amount. In addition, difference vectors can be tracked to determine whether the reference vector should be changed because of a change in the protected space which is not due to an intrusion, e.g. a temperature change.

The choice of frequency is important in eliminating false positives. It is desirable to have a wavelength long enough to be unresponsive to the movement of small animals but not so long as it is inefficient. It is believed that 1 KHz is optimal, but 500 Hz to 2 KHz is useful and frequencies outside this range can be practical in certain circumstances. As such, the emitters will produce an audible sound. It will therefore be appreciated that the detection system of the invention is ideally utilized in a space where the audible sound will not be annoying to nearby humans who are not intruders. Thus, the detection system ideally suited for protecting commercial space which is uninhabited during the time the system is active. Such spaces include warehouses, retail stores, office buildings, schools, etc. It is desirable that the digital processing of the microphone output be exactly related to the PCM data link to simplify the circuits. Because the emitters are audible, they provide a clear indication that they are working and they can be used as annunciators to indicate an emergency condition by coming on during business hours with either a steady or a pulsing tone.

The detection system is non-sensitive to normal and abnormal ambient sounds in the protected space such as weather sounds, traffic sounds, ventilation system sounds, ringing phones, banging radiators and the like, which in many cases cause serious problems with state of the art motion detectors and sound threshold detectors.

Since the system is a single frequency, very narrow band system, it is possible to exclude the vast majority of ambient acoustic energy with band pass filters. Preferably there is a passive band pass filter in the detector's (microphone's) electronics. This provides the system with an improved signal to ambient noise ratio and provides excellent dynamic range by protecting the other electronics. The primary narrow band filter function is accomplished by a simple algorithm at the ADC output.

Those skilled in the art will appreciate that a relatively echoic (having sound reflecting surfaces) space is desirable for the invention to work optimally. A good location for the sensor in most cases is near (but not at) the center of the protected space on the ceiling. Preferably the speakers and microphones are aimed at the corners of the space.

Additional objects and advantages of the invention will become apparent to those skilled in the art upon reference to the detailed description taken in conjunction with the provided figures.

BRIEF DESCRIPTION OF THE DRAWINGS

FIG. 6 is a more detailed view of functional block 28 in FIG. 1.

DETAILED DESCRIPTION OF THE PREFERRED EMBODIMENT

Figure 1:
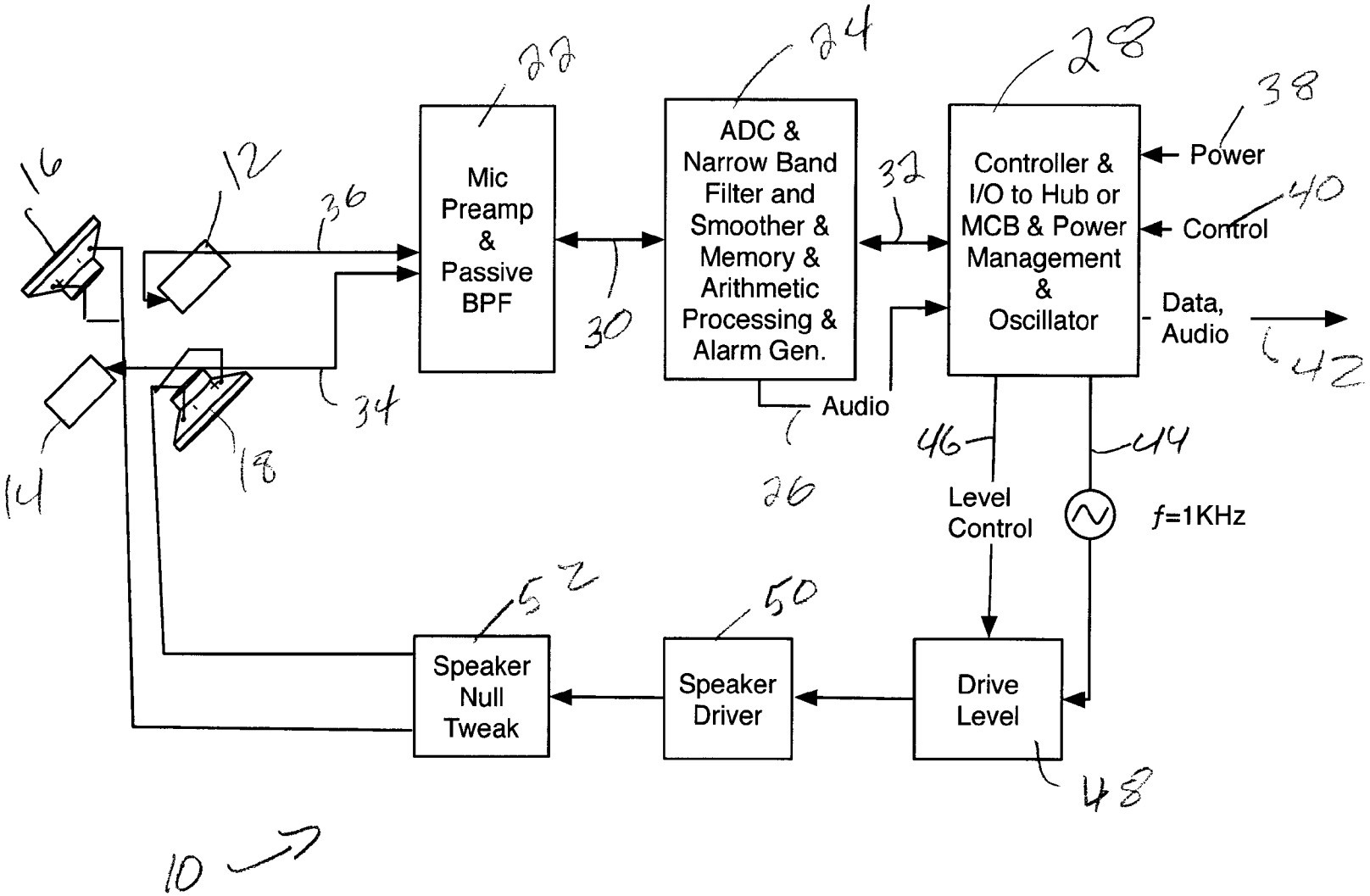
FIG. 1 is a high level schematic functional block diagram of an intrusion detection system according to the invention.

Turning now to FIG. 1, an acoustic intrusion detection system 10 according to the presently preferred embodiment of the invention includes two microphones (detectors) 12, 14 and two speakers (emitters) 16, 18. The microphones 12, 14 are located in the nulls of the speakers 16, 18, which are defined by locations where the sound emitted by the speakers is attenuated by at least 30 dB and preferably at least 40 dB (i.e. the detectors do not detect substantial sound directly from the emitters but only detect substantial sound from the emitters that is reflected). The outputs of the microphones 12, 14 are coupled to a first block 22 which includes a preamplifier and a passive band pass filter. The first block 22 is coupled to a second block 24 which includes an analog to digital converter, a narrow band filter and smoother, arithmetic processing and alarm signal generation, and, optionally, an audio output 26. The block 24 is coupled to a block 28 which includes a controller, I/O ports, power management, and an oscillator or master clock input. As shown in FIG. 1, blocks 22, 24, 28 are bidirectionally coupled at 30 and 32 and the microphones 12, 14 are bidirectionally coupled to the block 22 at 34, 36. The bidirectional couplings provide power from the block 28 to blocks 24 and 22 and to the microphones 12 and 14. The bidirectional coupling 32 also allows control signals to flow from block 28 to block 24.

As illustrated, the block 28 receives power and control signals at 38 and 40 and provides a data output at 42. The data output includes control feedback, alarm indication, and optionally digital audio. Optionally, the output could be a simple on/off indication or resistance for use in existing systems which contact/resistance switches. The block 28 also outputs an oscillating sine wave signal at 44 at the speakers' frequency and a level control at 46. These signals are fed to a drive level block 48 which sets the gain of the speaker driver 50. The oscillated frequency at the drive level is fed from the block 48 to the speaker driver 50 which is passed through a speaker null tweak circuit 52 (which changes the relative amplitude of the speakers) before driving speakers 16 and 18. Additional information about blocks 22, 24, 28, 50 and 52 is provided with reference to FIGS. 2-4.

Figure 2:
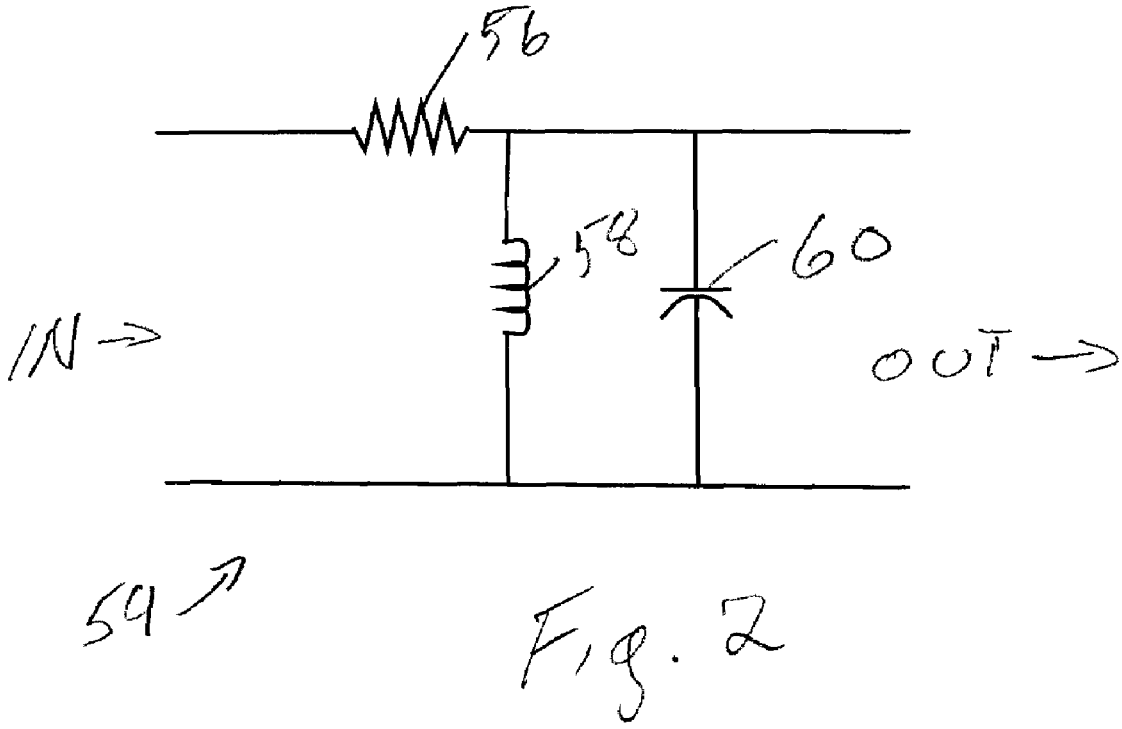
FIG. 2 is a more detailed illustration of the passive band pass filter of block 22 in FIG. 1.

Turning now to FIG. 2, the passive band pass filter in block 22 may be a simple circuit 54 which includes a resistor 56, an inductor 58, and a capacitor 60. This circuit defines a passive linear second order band pass filter. The center frequency f of the pass band is defined by Equation 1 where L is the value of the inductor and C is the value of the capacitor.

$$f = \frac{1}{2\pi\sqrt{LC}} \tag{1}$$

The width of the pass band is determined by the resistance of the resistor 56. In the preferred embodiment, the center of the pass band is 1 kilohertz and the width is 200 hertz.

Figure 3:
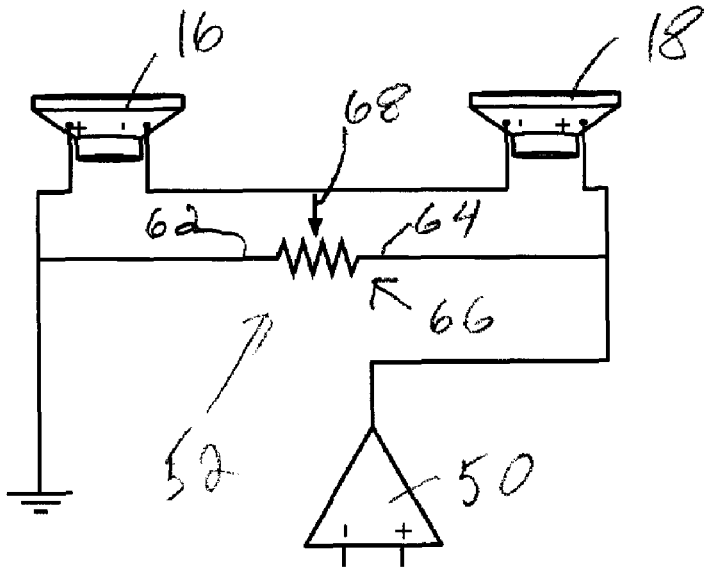
FIG. 3 is a more detailed view of the speaker null tweak.

FIG. 3 illustrates the speaker driver 50, the null tweak circuit 52, and how they are connected to the speakers so that the speakers are 180° out of phase. The speaker driver 50 is an amplifier which has a single output which is coupled to the positive pole of speaker 18. The negative pole of speaker 18 is coupled to the negative pole of speaker 16 and the positive pole of speaker 16 is coupled to ground. This produces an output at speaker 16 which is 180° out of phase with speaker 18. The positive poles of the speakers 16 and 18 are respectively coupled to the fixed contacts 62, 64 of a potentiometer 66 and the wiper 68 of the potentiometer 66 is coupled the negative poles of the speaker. The potentiometer 66 in this configuration acts as a voltage divider raising the volume of one speaker while lowering the volume of the other as the wiper is moved in one direction or the other. This serves to permit the fine tuning of the location of the speaker nulls electrically.

Figure 4:
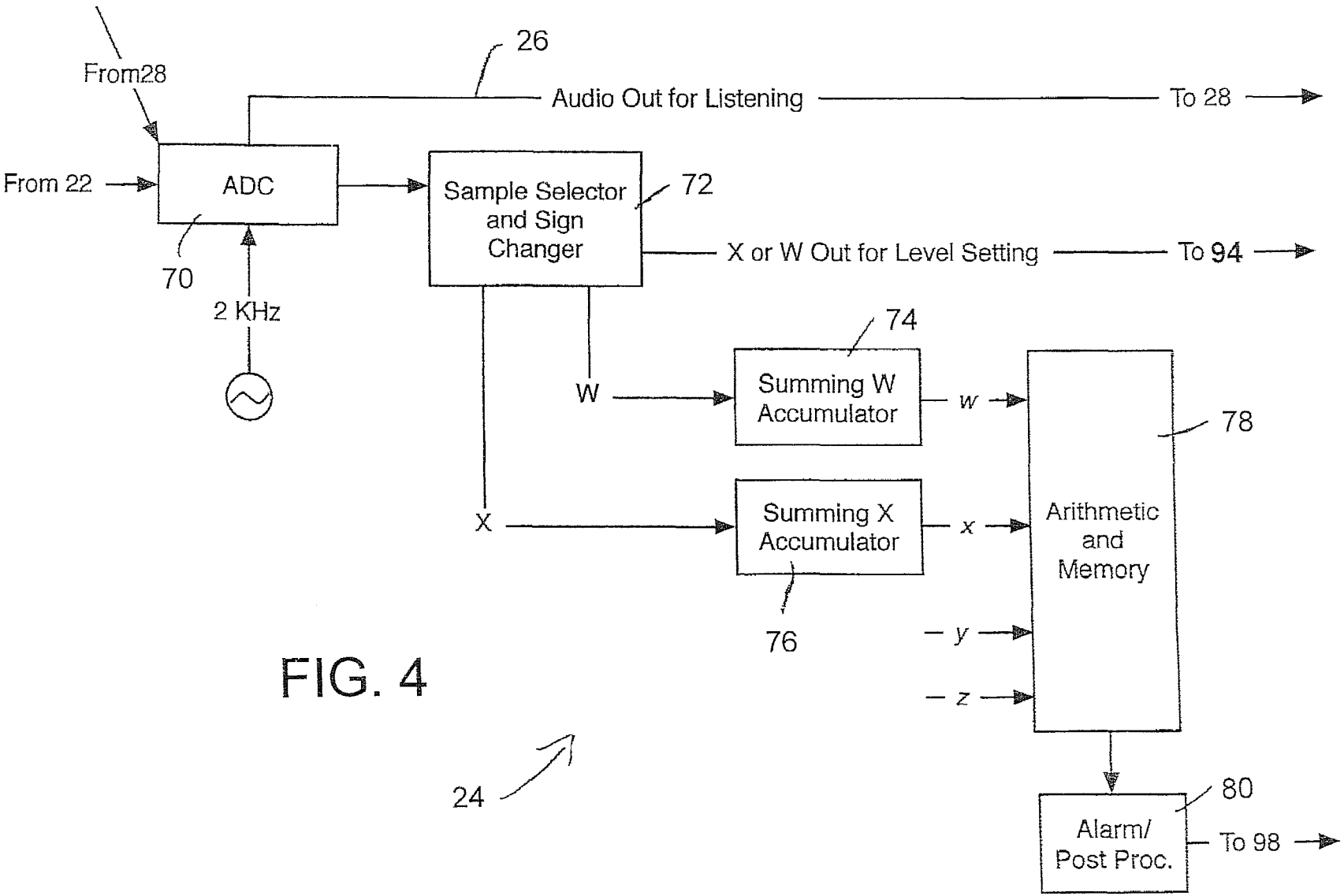
FIG. 4 is a more detailed view of functional block 24 in FIG. 1.

FIG. 4 shows a portion of the block 24 of FIG. 1. As mentioned above, two periodic samples are taken from each microphone's ADC. FIG. 4 shows the processing of samples from one ADC 70 coupled via microphone preamp and BPF 22 to microphone 12 (FIG. 1). The sampling frequency of the ADC is preferably twice the frequency f of the emitters, e.g. 2 KHz. It should be appreciated that portions of FIG. 4 will be replicated for microphone 14. The signals which are processed in block 24 (FIG. 1) are referred to as W, X, Y, Z and w, x, y, z. Signals W and X are sampled from the ADC 70 coupled to microphone 12 and signals Y and Z are sampled from the ADC (not shown) coupled to microphone 14. The processing of signals Y and Z is identical to the processing of signals W and X. Therefore, for simplicity, only signals W and X are explained.

Figure 5:
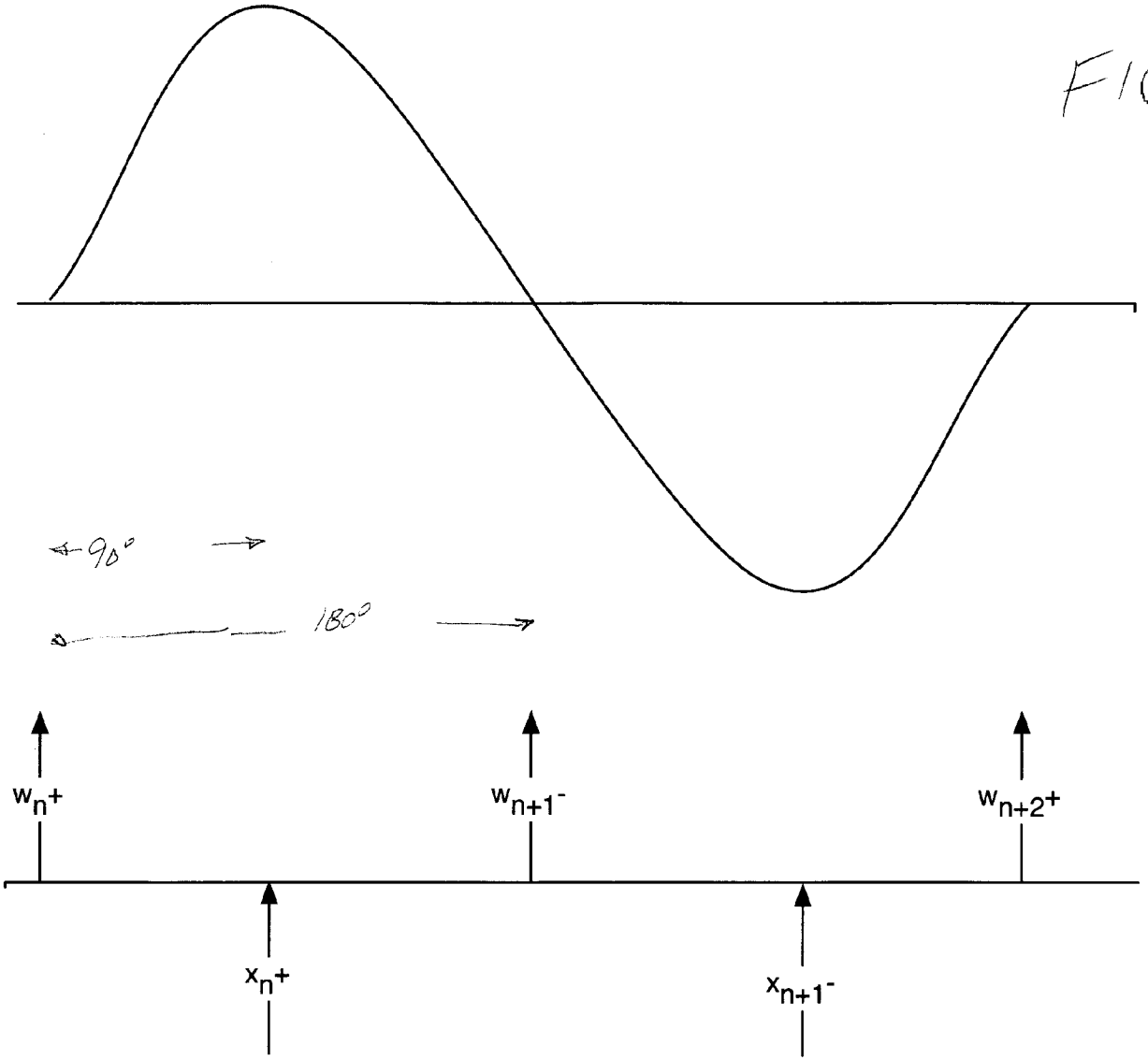
FIG. 5 is an illustration of the sampling performed by the narrow band filter and smoother of functional block 24 in FIG. 1.

Before continuing with the description of FIG. 4 it is useful to first consider FIG. 5. The upper portion of FIG. 5 shows a sine wave. This is intended to illustrate the output of ADC 70 in a conceptual way. It will be appreciated that the actual output of ADC 70 will be a series of binary numbers representing the changing amplitude of the sine wave pictured in FIG. 5. The lower portion of FIG. 5 illustrates the sampling of the output of ADC 70 performed by the sample selector 72. It should be noted that W samples are taken 180° apart from each other as are the X samples. However, the X samples are shifted 90° relative to the W samples. It should also be noted that every other W sample is sign changed and every other X sample is sign changed. The samples shown in FIG. 5 start at the beginning of the sine wave (0°) but in practice they can start anywhere. Thus, it should be appreciated that by negating the sign of every other sample, all of the W samples will have the same sign be it positive or negative depending where sampling begins. Similarly, by negating the sign of every other X sample, all of the X samples will have the same sign. This is not true for signals picked up by the microphones other than the audible tone frequency f, i.e. noise.

Returning now to FIG. 4, the sampling and sign changing is performed in block 72 which outputs samples W and X which in an exemplary embodiment are 16-bit binary numbers. The W numbers are fed to a 26-bit accumulator 74 which keeps a running total of the W numbers. Similarly, the X numbers are fed to a 26-bit accumulator 76 which keeps a running total of the X numbers. According to the presently preferred embodiment, the contents of the accumulators will be read after each 1,024 ($2^{10}$) entries have been made, i.e. approximately every ½ second. When the contents of the accumulators 74, 76 are read the 10 least significant bits are ignored (truncated). This has the effect of dividing the sum by in the accumulator 1,024, thus producing the average values w, x of the sampled values W, X. This sampling and averaging algorithm has the effect of narrow band filtering (noise reduction) because random (uncorrelated) noises at frequencies other than f will cancel each other out due to the sign changing over a large sample. The algorithm also has the effect of smoothing whatever noise is not filtered. As mentioned above, the same process is performed with regard to the output of microphone 14 to produce average values y, z which are shown in FIG. 4. According to the preferred embodiments of the invention, the numbers w, x, y, z are treated as the ordinates of four dimensional vector.

Upon startup, a reference vector is obtained and stored in the memory portion of block 78. Prior to determining the reference vector an operating amplitude is determined by slowly raising the volume of the speakers until they meet an operating level, e.g. 65 SPL (sound pressure level). The volume is raised slowly to account for the reverberation time of the protected space for frequency f. The reverberation time can be measured and compared to the previously measured reverberation time and gross changes in the space (e.g. open door, broken window, etc.) can thereby be detected. The ordinates of the reference vector are referred to as numbers $w_R$, $x_R$, $y_R$, $z_R$. The arithmetic portion of block 78 calculates the magnitude (scalar length) $L_R$ of the reference vector according to Equation 2 and stores it in the memory portion of block 78.

$$L_R=\sqrt{w_R^2+x_R^2+y_R^2+z_R^2} \tag{2}$$

After the reference vector and its magnitude are stored, the system continues to generate numbers $w_N$, $x_N$, $y_N$, $z_N$ every approximately ½ second. As those numbers are generated, the arithmetic portion of block 78 compares them to the reference vector in the following ways. First, a difference vector $w_D$, $x_D$, $y_D$, $z_D$ is calculated according to Equation 3.

$$w_D,x_D,y_D,z_D=(w_R-w_N),(x_R-x_N),(y_R-y_N),(z_R-z_N) \tag{3}$$

Then the magnitude $L_D$ of the difference vector is calculated according to Equation 4.

$$L_D=\sqrt{w_D^2+x_D^2+y_D^2+z_D^2} \tag{4}$$

Finally, the magnitude $L_D$ of the difference vector is compared to the magnitude $L_R$ of the reference vector according to Equation 5.

$$\frac{L_D - L_R}{L_R} \times 100 \geq m \tag{5}$$

If the magnitude exceeds a threshold m, an alarm may be generated at 80. According to the presently preferred embodiment, m is approximately 10. However, m could be changed via control signals (40 in FIG. 1) or could be adaptive at the time of installation based on test signals for example.

Turning now to FIG. 6, the block 28 of FIG. 1 is shown in more functional detail. The power control 82 receives line input 38 from power mains or some other source of power and supplies power to an oscillator 84, two frequency dividers 86, 88, a control receiver 90, a transmitter 92, an audio level detection and control 94, a listening mode toggle 96, and alarm post processing 98. The power control 82 also supplies power to functional block 24 (FIG. 1) which in turn supplies power to functional block 22 with power.

The oscillator 84 is an 8 KHz oscillator. Divider 86 divides by four and produces the 2 KHz clock that is used by the ADC (70 in FIG. 4). Divider 88 divides by the 2 KHz clock by two and supplies the 1 KHz frequency f used to drive the speakers.

The control receiver 90 is connected by a communications link 40 to a source of external control commands. Rhe control receiver 90 may then implement a command, e.g. to toggle into a listening mode using the toggle 96 which increases the sampling rate of the ADC to 8K and (if not already so coupled) redirects the output of the ADC (70 in FIG. 4) to the transmitter 92 which is connected to the same communications link. The audio level detection and control 94 monitors one or more of the W, X, Y, or Z signals and adjusts the drive level (48 in FIG. 1) to the appropriate volume. This may be performed autonomously or via a command from the control receiver. It will be appreciated that the appropriate volume is a function of the size of the protected space and how echoic it is. The volume will also be automatically adjusted by the audio level control 94 based on changes in temperature or any other change in the protected space which would warrant a volume change. A volume overload condition is indicated by the most significant bit (msb) of the accumulators 74, 76. If the msb is 1, the system is overloaded.

Alarm post processing 98 receives the alarm from 80 in FIG. 4 and determines whether an alarm should be sent to the transmitter 92. Post processing is optional but can reduce false alarms by performing a simple algorithm on the number and frequency of the alarm signals generated at 80. For example, the post processing may require a certain number of continuous alarms before transmitting the alarm over the communications link.

PRINCIPLES OF THE INVENTION

The following information is provided for the benefit of the reader and should not be taken as limiting the invention in any way. The inventor believes these are the principles which explain why the invention works so well and achieves all of the benefits described above. However, if these principles should prove to be inaccurate, incorrect, or incomplete it should in no way affect the validity or scope of the claims.

When the system is started and the audible tone is heard, the protected space is filled with the tone as far as the tone can be heard. This includes around corners and beyond lines of sight. The tone and the space define a three dimensional stationary energy pattern which exhibits maximum and minimum energy levels in different locations within the space with a fixed phase relationship to each other, to the emitter, and to any other acoustic energy of the same frequency f.

The stationary energy pattern is determined by the physical acoustic boundaries of the protected space, including walls, floor, ceiling, doors, windows, furniture, and whatever other objects which have a dimension greater than ¼ wavelength of f and their acoustic absorption/reflection properties at frequency f. The pattern is also determined by the speed of sound which is affected by temperature, humidity, stratification of temperature, and turbulence. The granularity of the pattern is mostly a function of the frequency f. Higher frequencies will detect smaller changes in the acoustic boundaries of the protected space but will be more sensitive to temperature changes. The frequency of 1 KHz was chosen because it has a wavelength of about one foot. Thus, small insignificant changes will not be detected and a false alarm will not be generated by such small changes. The lower the frequency, the more energy is needed to generate it. Here, also 1 KHz was thought to be a good compromise.

The stationary acoustic energy pattern can be analogized to a room full of bubbles. A disturbance of the bubbles in one part of the room will necessarily affect all of the bubbles to some degree.

The system of the invention is not really a motion detector. Rather, it is a "change" detector in that it can detect a change to a static protected space. For example, if the reference vector is remembered after the system is shut off and something in the space is changed (e.g., a door is opened, furniture is moved, a window is broken or opened), when the system turned back on, the change will be detected. However, the practical application of the invention will effectively detect motion as well, since motion will change the state of the acoustic energy pattern.

In theory, the system could be used in a completely non-echoic space provided that the change in the acoustic energy pattern is effected by something which is echoic. However, that situation would be unused.

There have been described and illustrated herein an acoustic intrusion detection system. While particular embodiments of the invention have been described, it is not intended that the invention be limited thereto, as it is intended that the invention be as broad in scope as the art will allow and that the specification be read likewise. For example, the figures are all schematic and the speakers shown schematically in FIG. 1 would need enclosures to minimize sound emanating from the rear and sides of the speakers. The speakers could be mounted at opposite ends of a tube such that the assembly has a resonance at f and this would save drive power. A single speaker could be used as could a single detector if properly located relative to each other, although systems using only single speakers or single detectors are less than optimal and are harder to place. The null tweak can be effected mechanically rather than electrically. In the case of tubes (regardless of the number of speakers) the ends of the tube could be flared or horn shaped to make the emitter(s) more directional and to minimize diffraction all of which would improve the nulls by making them bigger and eliminating the need for a tweaker. If listening mode is not required, an acoustical band pass filter could be used at the microphones rather than the electrical band pass filter shown. This could also allow for fewer bits at the ADC. The system could be partitioned in many different ways. For example, the remote head could include the speakers, microphones, null tweak, preamp and passive filters and the remainder of the circuits located at central location in the building. It will also be appreciated that because of the nature of the system, it can detect open or broken windows in addition to intrusions. Those skilled in the art will appreciate that the sampling and averaging algorithms according to the invention are accurate and efficient, other active filters could produce acceptable results. For example, an elaborate digital signal processor could be arranged to perform narrow band or low band filtering. However, whatever filter is used, it preferably should not have ringing in excess of 2% (compare the preferred active filter according to the invention which has no ringing). While the detectors have been described as being spaced apart ¼ wavelength of f, they could be spaced apart n/2 wavelengths plus ¼ wavelength and still produce the same benefit (if the sign changing rules are changed in appropriate circumstances) that guarantees that at least one detector will be located outside a node of the stationary. In embodiments which have two detectors, it is possible to extract some stereo (directional) information and use that to indicate where the intrusion occurred. While it is usually preferred that all of the systems operate at the same frequency, there may be some applications where it is desirable to have some isolated systems operating at different frequencies. It will therefore be appreciated by those skilled in the art that yet other modifications could be made to the provided invention without deviating from its spirit and scope as claimed.

What is claimed is:

1. An acoustic intrusion detection system, comprising:

at least one sound emitter, emitting sound at a humanly audible frequency;

at least one sound detector arranged relative to said at least one sound emitter such that said sound detector does not detect substantial sound directly from the at least one sound emitter but only detects substantial sound from the at least one sound emitter that is reflected; and a circuit coupled to said detector for indicating an intrusion.

2. The system according to claim 1, wherein:

said at least one sound emitter comprises two sound emitters, and said at least one sound detector comprises two sound detectors.

3. The system according to claim 1, wherein:

said at least one sound emitter comprises a tube and at least one speaker.

4. The system according to claim 3, wherein:

said at least one sound emitter comprises a tube and two speakers arranged such that said tube and speakers resonate.

5. The system according to claim 2, wherein:

said sound emitters are 180° out of phase relative to each other.

6. The system according to claim 2, wherein:

said sound detectors are spaced apart from each other by one quarter of the wavelength of said audible frequency.

7. The system according to claim 1, wherein: said audible frequency is between 500 Hz to 2 KHz.

8. The system according to claim 5, wherein:

said sound detectors are located in the non-echoic nulls of said sound emitters.

9. The system according to claim 1, wherein:

said system detects intrusions around corners.

10. The system according to claim 1, wherein:

said system detects non-movement intrusions.

11. The system according to claim 2, wherein:

said circuit includes a digital circuit coupled to outputs of said detectors, said circuit including an active narrow-band digital filter.

12. The system according to claim 11, wherein:

said active narrow-band digital filter comprises an analog-to-digital converter having an output coupled to a sample selector and sign changer having in turn an output coupled to an accumulator from which a periodic value is obtained.

13. The system according to claim 11, wherein:

said circuit having an output which indicates ordinates of a four dimensional vector.

14. The system according to claim 13, further comprising:

a storage means coupled to said digital circuit output for storing a reference vector; and arithmetic means coupled to said storage means, wherein said output periodically indicating ordinates of a new four dimensional vector and said arithmetic means compares the new four dimensional vector with the reference vector.

15. A method for detecting an intrusion into a protected space, comprising:

generating a humanly audible tone;

detecting a reference amplitude and phase of the tone when there is no motion and low noise in the protected space;

storing the reference amplitude and phase as a reference vector;

periodically detecting a new amplitude and phase;

storing the new amplitude and phase as a new vector;

comparing the new amplitude and phase with the reference vector; and determining an intrusion based on said comparing.

16. The method according to claim 15, wherein:

said step of comparing includes determining a difference vector from said reference vector and said new vector.

17. The method according to claim 16, wherein:

said step of comparing includes comparing the magnitude of the reference vector with the magnitude of the difference vector.

18. A method for detecting an intrusion into a protected space, comprising:

generating a humanly audible stationary wave having frequency f;

detecting said audible stationary wave with two detectors spaced apart n/2 wavelengths plus approximately one quarter wavelength of f where n>0; and determining an intrusion based on a change exceeding a threshold in said detecting.

19. An acoustic intrusion detection system, comprising:

a plurality of sonic emitters;

a plurality of sonic detectors which detect sonic signals; and a circuit coupled to said detectors for indicating an intrusion upon detecting a change in said sonic signals exceeding a threshold, wherein said plurality of sonic emitters are all coupled to a central clock and thereby all emit the same frequency f, and 500 Hz<f<2,000 Hz.

* * * * *